US007171248B1

(12) United States Patent
Brown

(10) Patent No.: US 7,171,248 B1
(45) Date of Patent: Jan. 30, 2007

(54) ELECTROMAGNETIC SHIELDING SYSTEM

(75) Inventor: Larry K. Brown, 11106 Rubin St., Houston, TX (US) 77047

(73) Assignee: Larry K. Brown, Houston, TX (US)

( * ) Notice: Subject to any disclaimer, the term of this patent is extended or adjusted under 35 U.S.C. 154(b) by 1412 days.

(21) Appl. No.: 09/944,003

(22) Filed: Aug. 31, 2001

(51) Int. Cl.
*H01Q 1/52* (2006.01)

(52) U.S. Cl. ..... 455/575.5; 455/575.1; 455/117; 343/841

(58) Field of Classification Search ..... 343/839, 343/841, 880, 915; 455/575.1, 575.3, 575.5, 455/575.6, 575.8, 117, 271
See application file for complete search history.

(56) References Cited

U.S. PATENT DOCUMENTS

| | | | | |
|---|---|---|---|---|
| 5,335,366 | A | 8/1994 | Daniels | |
| 5,338,896 | A * | 8/1994 | Danforth | 174/35 R |
| 5,657,386 | A * | 8/1997 | Schwanke | 379/433.13 |
| 5,666,125 | A | 9/1997 | Luxon et al. | |
| D395,898 | S | 7/1998 | Suzuki | |
| 5,787,340 | A * | 7/1998 | Sepponen | 455/575.5 |
| 5,819,162 | A * | 10/1998 | Spann et al. | 455/575.5 |
| 6,075,977 | A * | 6/2000 | Bayrami | 455/575.5 |
| 6,088,603 | A * | 7/2000 | Wilson | 455/575.5 |
| 6,095,820 | A | 8/2000 | Luxon et al. | |
| 2001/0041545 | A1* | 11/2001 | Liberman et al. | 455/117 |
| 2002/0009976 | A1* | 1/2002 | Rashidi | 455/90 |

* cited by examiner

*Primary Examiner*—William Trost
*Assistant Examiner*—Aung T Win

(57) ABSTRACT

An electromagnetic shielding system for shielding a user's head from electromagnetic waves produced from an antenna of a cellular phone. The electromagnetic shielding system includes an expandable shield assembly that includes a base panel and an arm panel pivotally coupled together for providing an expanded area of coverage for a user's head. The base panel is removably mountable to the antenna of a cellular phone. An electromagnetic reflective member is mounted to the shield assembly for shielding a user from the electromagnetic waves. A coupling assembly is removably mountable to and extends between the shield assembly and the antenna of the cellular phone for positioning the expandable shield assembly between a stored position and a shielding position.

17 Claims, 4 Drawing Sheets

ELECTROMAGNETIC SHIELDING SYSTEM

BACKGROUND OF THE INVENTION

1. Field of the Invention

The present invention relates to electromagnetic shielding systems and more particularly pertains to a new electromagnetic shielding system for shielding a user's head from electromagnetic waves produced from a cellular phone. The cellular phone has at least a front face having a plurality of buttons and a display.

2. Description of the Prior Art

The use of electromagnetic shielding systems is known in the prior art. More specifically, electromagnetic shielding systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,095,820; U.S. Pat. No. 5,666,125; U.S. Pat. No. 6,075,977; U.S. Pat. No. 5,657,386; U.S. Pat. No. 5,335,366; and U.S. patent No. Des. 395,898.

While these devices fulfill their respective, particular objectives and requirements, the aforementioned patents do not disclose a new electromagnetic shielding system. The inventive device includes an expandable shield assembly including a base panel and an arm panel pivotally coupled together for providing an expanded area of coverage for a user's head. The base panel is removably mountable to an antenna of a cellular phone. An electromagnetic reflective member is mounted to the shield assembly for shielding a user from electromagnetic waves produced from the antenna. A coupling assembly is removably mountable to and extends between the shield assembly and the antenna of the cellular phone for positioning the expandable shield assembly between a stored position and a shielding position. In one embodiment of the present invention, the stored position is characterized by the expandable shield assembly being positioned generally adjacent to and selectively covers a rear of the cellular phone. The shielding position is characterized by the shield assembly being positioned between a user's head and the antenna of the cellular phone.

In these respects, the electromagnetic shielding system according to the present invention substantially departs from the conventional concepts and designs of the prior art, and in so doing provides an apparatus primarily developed for the purpose of shielding a user's head from electromagnetic waves produced from a cellular phone. The cellular phone has at least a front face having a plurality of buttons and a display.

SUMMARY OF THE INVENTION

In view of the foregoing disadvantages inherent in the known types of electromagnetic shielding systems now present in the prior art, the present invention provides a new electromagnetic shielding system construction wherein the same can be utilized for shielding a user's head from electromagnetic waves produced from a cellular phone. The cellular phone has at least a front face having a plurality of buttons and a display.

The general purpose of the present invention, which will be described subsequently in greater detail, is to provide a new electromagnetic shielding system apparatus and method which has many of the advantages of the electromagnetic shielding systems mentioned heretofore and many novel features that result in a new electromagnetic shielding system which is not anticipated, rendered obvious, suggested, or even implied by any of the prior art electromagnetic shielding systems, either alone or in any combination thereof.

To attain this, the present invention generally comprises an expandable shield assembly including a base panel and an arm panel pivotally coupled together for providing an expanded area of coverage for a user's head. The base panel is removably mountable to an antenna of a cellular phone. An electromagnetic reflective member is mounted to the shield assembly for shielding a user from electromagnetic waves. A coupling assembly is removably mountable to and extends between the shield assembly and the antenna of the cellular phone for positioning the expandable shield assembly between a stored position and a shielding position. In one embodiment of the present invention, the stored position is characterized by the expandable shield assembly being positioned generally adjacent to and selectively cover a rear of the cellular phone. The shielding position is characterized by the shield assembly being positioned between a user's head and the antenna of the cellular phone.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electromagnetic shielding system apparatus and method which has many of the advantages of the electromagnetic shielding systems mentioned heretofore and many novel features that result in a new electromagnetic shielding system which is not anticipated, rendered obvious, suggested, or even implied by any of the prior art electromagnetic shielding systems, either alone or in any combination thereof.

It is another object of the present invention to provide a new electromagnetic shielding system which may be easily and efficiently manufactured and marketed.

It is a further object of the present invention to provide a new electromagnetic shielding system which is of a durable and reliable construction.

An even further object of the present invention is to provide a new electromagnetic shielding system which is susceptible of a low cost of manufacture with regard to both materials and labor, and which accordingly is then susceptible of low prices of sale to the consuming public, thereby making such electromagnetic shielding system economically available to the buying public.

Still yet another object of the present invention is to provide a new electromagnetic shielding system which provides in the apparatuses and methods of the prior art some of the advantages thereof, while simultaneously overcoming some of the disadvantages normally associated therewith.

Still another object of the present invention is to provide a new electromagnetic shielding system for shielding a user's head from electromagnetic waves produced from a cellular phone. The cellular phone has at least a front face having a plurality of buttons and a display.

Yet another object of the present invention is to provide a new electromagnetic shielding system which includes an expandable shield assembly including a base panel and an arm panel pivotally coupled together for providing an expanded area of coverage for a user's head. The base panel is removably mountable to an antenna of a cellular phone. An electromagnetic reflective member is mounted to the shield assembly for shielding a user from electromagnetic waves. A coupling assembly is removably mountable to and extends between the shield assembly and the antenna of the cellular phone for positioning the expandable shield assembly between a stored position and a shielding position. In one embodiment of the present invention, the stored position is characterized by the expandable shield assembly being positioned generally adjacent to and selectively cover a rear of the cellular phone. The shielding position is characterized by the shield assembly being positioned between a user's head and the antenna of the cellular phone.

Still yet another object of the present invention is to provide a new electromagnetic shielding system that reflects electromagnetic waves away from a user's head. In recent years, there has been a large amount of discussion concerning the possible link between radio and electromagnetic waves produced from cellular phone antennas and brain caner. The present invention address and solves the problem by reflecting these waves away from a user's head.

Even still another object of the present invention is to provide a new electromagnetic shielding system that does not reduce or degrade the incoming radio signal. The present invention employs a reflective member that merely reflects radio and electromagnetic waves away from a user's head permitting the antenna to still receive these waves.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
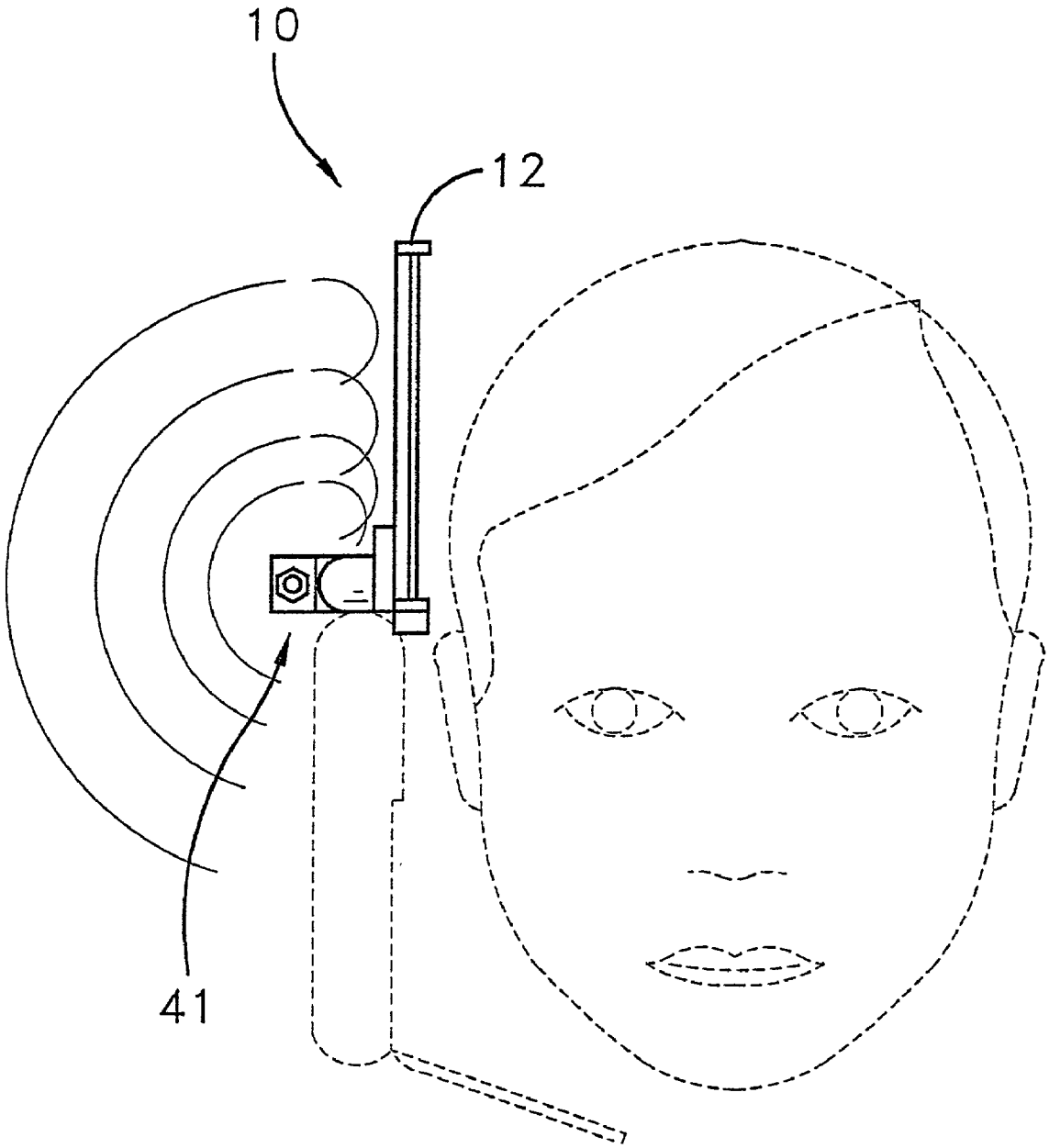
FIG. 1 is a schematic side view of a new electromagnetic shielding system according to the present invention.

With reference now to the drawings, and in particular to FIGS. 1 through 5 thereof, a new electromagnetic shielding system embodying the principles and concepts of the present invention and generally designated by the reference numeral 10 will be described.

As best illustrated in FIGS. 1 through 5, the electromagnetic shielding system 10 generally comprises an expandable shield assembly 12 that includes a base panel 13 and an arm panel 14 that are pivotally coupled together for providing an expanded area of coverage for a user's head. The base panel 13 is removably mountable to an antenna of a cellular phone.

The base panel 13 has a first end 15, a second end 16, opposed front 17 and rear 18 planar surfaces and a peripheral edge surface 19. The base panel 13 may comprise a substantially lightweight rigid material such as, for example, a plastic.

Figure 2:
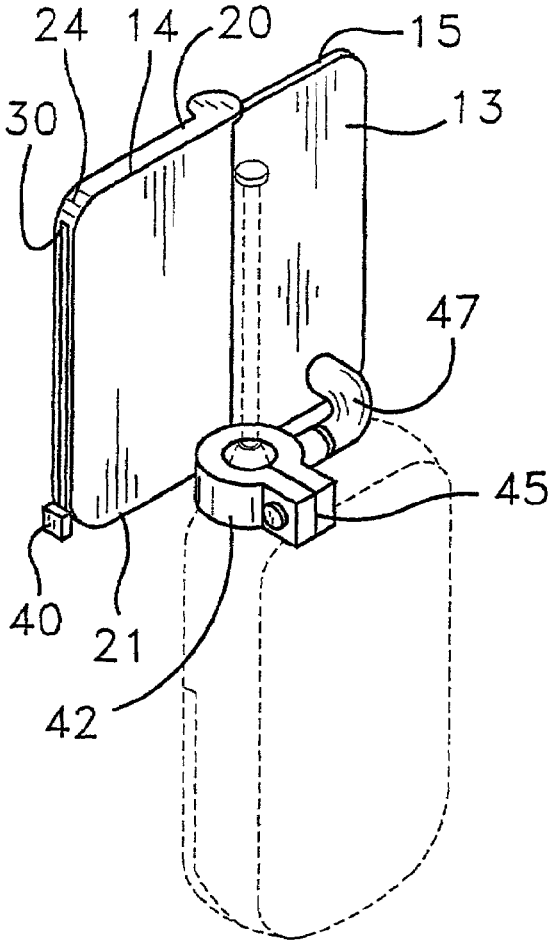
FIG. 2 is a schematic perspective view of the present invention.
Figure 3:
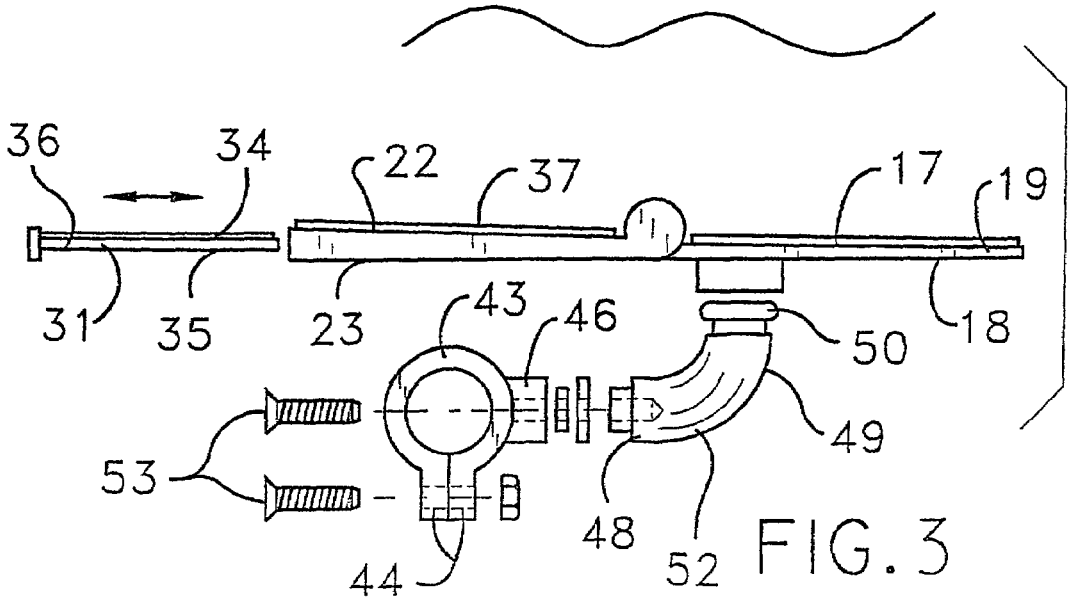
FIG. 3 is a schematic top exploded view of the present invention.

The arm panel 14 has a first end 20, a second end 21, opposed front 22 and rear 23 planar surfaces and a peripheral edge surface 24. In one embodiment of the present invention, as particularly illustrated in FIGS. 1 and 2, the peripheral edge surfaces 19 and 24 of the base panel 13 and the arm panel 14 are pivotally coupled together. As illustrated in FIG. 3, the arm panel 14 has a thickness that may taper from an end of the arm panel toward a juncture between the arm panel 14 and the base panel 13.

Figure 4:
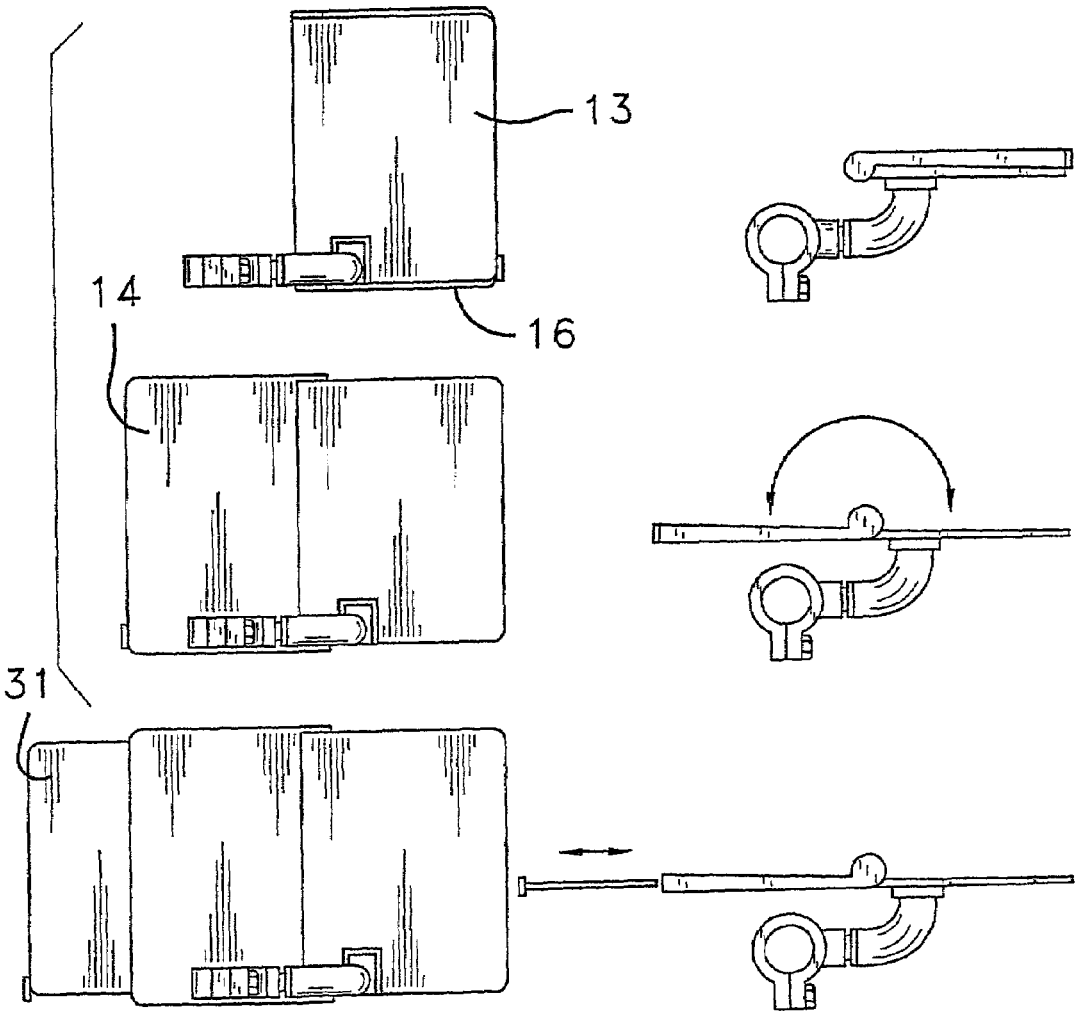
FIG. 4 is a schematic rear view of the present invention.

In one embodiment of the present invention, as particularly illustrated in FIG. 4, the base panel 13 and the arm panel 14 are positionable between a closed position and an open position. The closed position is characterized by the front planar surfaces 17 and 22 of the base 13 and arm 14 panels being selectively abutted against each other, as illustrated in the top figure of FIG. 4. As illustrated in FIGS. 3 and 4, the open position is characterized by the front 17 and 22 and rear 18 and 23 planar surfaces of the base 13 and arm 14 panels lying in the same plane.

In one embodiment of the present invention the peripheral edge surface 24 of the arm panel 14 may have an elongated channel 30 extending into the arm panel 14. A deflector panel 31 may be slidably mounted in the elongated channel 30 for providing expanded protection to a user's head from electromagnetic waves. As illustrated in FIG. 2, the deflector panel 31 is preferably positionable between the front 22 and rear 23 planar surfaces of the arm panel 14. The deflector panel 31 has opposed front 34 and rear 35 planar surfaces and a peripheral edge surface 36.

An electromagnetic reflective member 37 is mounted to and covers the front planar surfaces 17, 22 and 34 of each of the panels 13, 14 and 31 of the shield assembly 12 for shielding a user from electromagnetic waves emitted by the antenna of the cellular phone. In one embodiment of the present invention, the electromagnetic reflecting member 37 may comprise a radio frequency reflective tape or any other type of material capable of deflecting electromagnetic waves.

A handle 40 may be mounted to the peripheral edge surface of the deflector panel 31 for slidably positioning the deflector panel between a retracted position and an extended position. In one embodiment of the present invention, as illustrated in the middle and bottom figures of FIG. 4, the retracted position is characterized by the deflector panel 31 being positioned between the front 22 and rear 23 planar surfaces of the arm panel 14. The extended position is characterized by a user pulling the handle 40 such that the deflector panel 31 extends out of the elongated channel 30.

In one embodiment of the present invention, the shield assembly 12 comprises a substantially rigid material such as, for example, a lightweight plastic. Other materials may also be employed in the manufacture of the shield assembly 12.

A coupling assembly 41 is removably mountable to and extending between the rear planar surface 18 of the base panel 13 of the shield assembly 12 and the antenna of the cellular phone. The coupling assembly 41 is employed for positioning the expandable shield assembly 12 between a stored position and a shielding position. In one embodiment of the present invention, the stored position is characterized by the expandable shield assembly 12 being positioned generally adjacent to and selectively cover a rear of the cellular phone. The rear of the cellular phone generally has a battery for powering the cellular phone. The rear location of the shield assembly 12 in the closed position permits a user to dial and see the display without having to move the shield assembly 12. The shielding position is characterized by the shield assembly 12 being positioned between a user's head and the antenna of the cellular phone.

The coupling assembly 41 may include a clamp 42 that has an annular portion 43 with a pair of tabs 44 defining an opening 45. The tabs 44 are pulled apart by a user for increasing an inner diameter of the annular portion 43 for removably mounting the clamp 42 onto and about the antenna of the cellular phone. The clamp 42 may comprise a substantially rigid material such as, for example, a plastic or metal material. However, other types of materials may also be employed.

The clamp 42 may also include a post portion 46 being coupled to and extending away from said annular portion 43 of said clamp 42. The post portion 46 is may be positioned generally adjacent to said pair of tabs 44.

The coupling assembly 41 may also include a securing portion 47 extending between and being coupled to the post portion 46 and the shield assembly 12. The securing portion 41 has a first end 48 rotatably mounted to the post portion 46 of the clamp 42 for moving the shield assembly 12 between the stored position and the shielding position. In one embodiment of the present invention, as particularly illustrated in FIG. 3, a locking washer and a neoprene washer may be positioned between the second end 48 of the securing portion 47 and the post portion 46 of the coupling assembly 41.

In one embodiment of the present invention, a second end 49 of the securing portion 47 may be releasably coupled to the rear planar surface 18 of the base panel 13 of the shield assembly 12. The second end 49 of the securing portion has an annular ridge 50 formed thereon extending about the securing portion 47 such that an annular groove 51 extends about the securing portion 47 adjacent to the annular ridge 50.

In one embodiment of the present invention, the securing portion 47 has a bend 52 therein for positioning the shield assembly 12 adjacent to the front face of the cellular phone and parallel to the rear of the cellular phone when a user moves the shield assembly 12 between the shielding position and the stored position.

A fastening means 53 may be mounted to and may extend through each of the tabs 44 of the annular portion 43 of the coupling assembly 41 for securing the tabs 44 together and fastening the annular portion 43 to the antenna of the cellular phone. A fastening means 53 may also extend through the post portion 46 of the clamp 42 and into the first end 48 of the securing portion 47 for rotatably securing the securing portion 47 to the post portion 46.

In one embodiment of the present invention, the fastening means 53 may comprise screw. However, other types of fastening means may also be employed such as, for example, a nut and a bolt.

Figure 5:
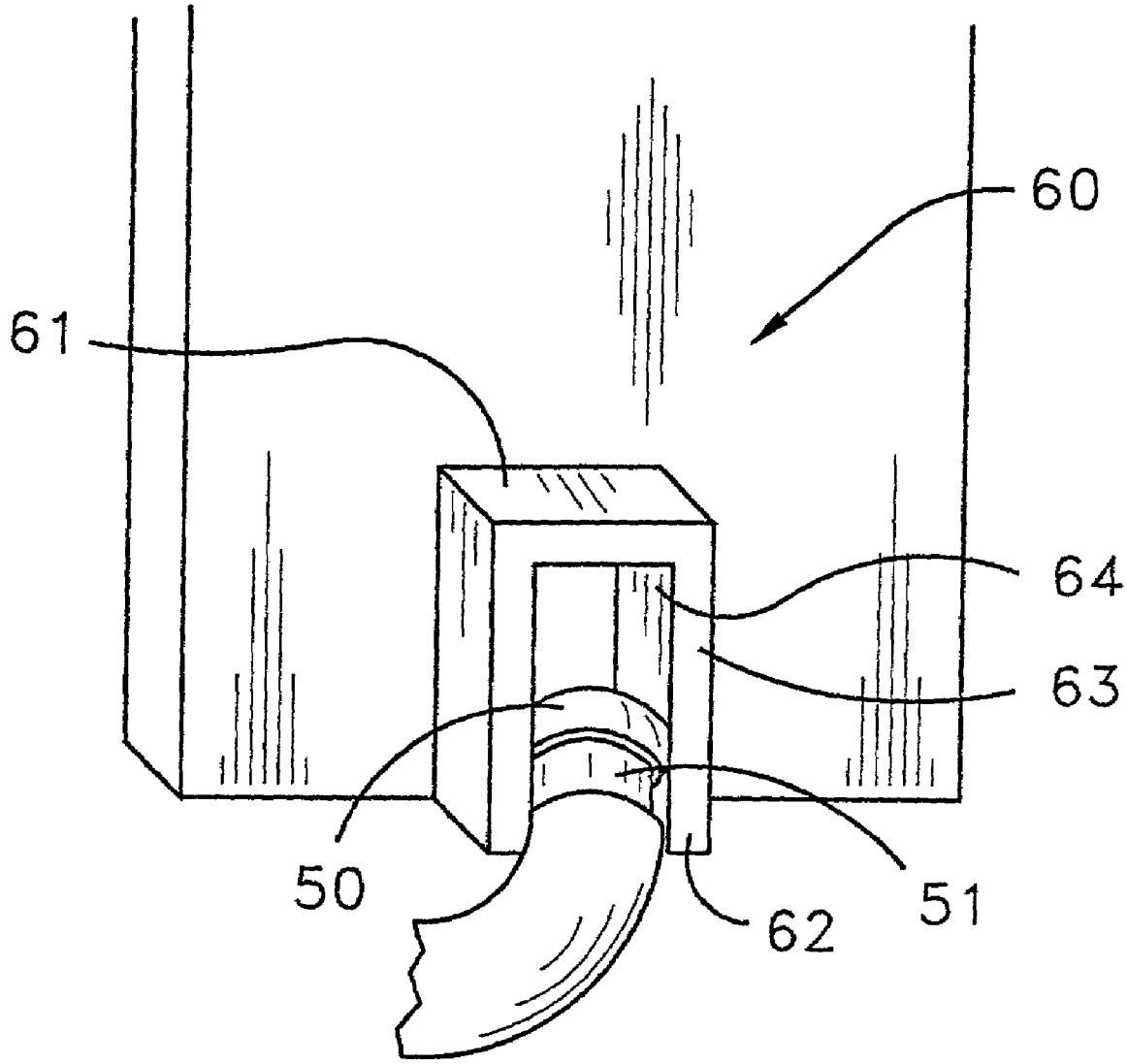
FIG. 5 is a schematic perspective view of the present invention.

As illustrated in FIG. 5, a housing 60 may be mounted to the rear planar surface 18 of the base panel 13 for receiving the second end 49 of the securing portion 47 of the coupling assembly 41. The housing 60 has a first end 61, an open second end 62 and a peripheral wall 63 extending between the first end 61 and the open second end 62 of the housing 60.

The peripheral wall 63 of the housing 60 has a channel 64 extending from the open second end 62 of the housing 60 toward the first end 61 of the housing 60. In one embodiment of the present invention, the annular ridge 50 of the securing portion 47 is removably secured in the housing 60 through the open second end 62 of the housing 60. In one embodiment of the present invention, the peripheral wall 63 of the housing 60 is positioned in the annular groove 51 of the securing portion 47. A clip means may be mounted in the housing 60 for releasably securing the annular ridge 50 of the securing portion 47 in the housing 60.

In one embodiment of the present invention the shield assembly 12 may rotate with respect to the securing portion 47 of the coupling assembly 41. Rotating the shield assembly 12 permits a user to position the shield assembly 12 to provide optimum protection from the electromagnetic waves emitted from the antenna of the cellular phone.

In use, a user moves the shield assembly 12 from the stored position to the shielding position when the user is going to make a phone call or answer an incoming call. Once the shield assembly 12 is in the shielding position the user pivots the arm panel 14 from the closed position to the open position to completely shield the user's head from the antenna of the cellular phone. Once the arm panel 14 is in the open position a user may use the handle 40 to move the deflector panel 31 from the retracted position to the extended position. The deflector panel 31 provides a user with expanded coverage from the electromagnetic waves produced by the antenna of the cellular phone.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electromagnetic shielding system for shielding a user's head from electromagnetic waves produced from a cellular phone, the cellular phone having an antenna, and a front and a rear, the front having a plurality of buttons and a display, said system comprising:

an expandable shield assembly including a base panel and an arm panel being pivotally coupled together, said base panel being removably mountable to the antenna of the cellular phone; and a coupling assembly mounted on the shield assembly for removably mounting on the antenna of the cellular phone, said coupling assembly being adapted to position said expandable shield assembly in a stored position and a shielding position, wherein said stored position is characterized by said expandable shield assembly being positionable generally adjacent to the rear of the cellular phone, wherein said shielding position is characterized by said shield assembly being positionable between a user's head and the antenna of the cellular phone.

2. The electromagnetic shielding system of claim 1, wherein said base panel has a first end, a second end, opposite and generally planar front and rear surfaces, and a peripheral edge surface.

3. The electromagnetic shielding system of claim 2, wherein said arm panel has a first end, a second end, opposite and generally planar front and rear surfaces, and a peripheral edge surface, wherein said peripheral edge surfaces of said base panel and said arm panel are pivotally coupled together.

4. The electromagnetic shielding system claim of claim 3, wherein said base panel and said arm panel are positionable between a closed position and an open position, wherein said closed position is characterized by said front surfaces of said base and arm panels are abutted against each other, wherein said open position is characterized by said front and rear surfaces of said base and arm panels lying in substantially the same plane.

5. The electromagnetic shielding system of claim 3, wherein said peripheral edge surface of said arm panel has an elongated channel extending into said arm panel; and a deflector panel being slidably mounted in said elongated channel for providing protection to a user's head, said deflector panel being positionable between said front and rear surfaces of said arm panel.

6. The electromagnetic shielding system of claim 5, wherein said deflector panel has opposite and generally planar front and rear surfaces, and a peripheral edge surface; and a handle being mounted to said peripheral edge surface of said deflector panel for slidably positioning said deflector panel between a retracted position and an extended position, wherein said retracted position is characterized by said deflector panel being positioned between said front and rear surfaces of said arm panel, wherein said extended position is characterized by a user pulling said handle such that said deflector panel extends out of said elongated channel.

7. The electromagnetic shielding system of claim 1, wherein said shield assembly comprises a substantially rigid material.

8. The electromagnetic shielding system of claim 1, wherein said coupling assembly includes:

a clamp having an annular portion with a pair of tabs defining an opening, wherein said annular portion is removably mountable about the antenna of the cellular phone, a post portion being mounted to said annular; and a securing portion for extending between and being coupled to said annular portion and said shield assembly.

9. The electromagnetic shielding system of claim 8, additionally including a fastening means being mounted to and extending through each of said tabs of said annular portions of said coupling assembly for securing said tabs together.

10. The electromagnetic shielding system of claim 9, wherein said fastening means comprises a screw.

11. The electromagnetic shielding system of claim 8, wherein said securing portion has a first end rotatably mounted to said post portion of said clamp for moving said shield assembly between said stored position and said shielding position, said securing portion having a second end being releasably coupled to said shield assembly.

12. The electromagnetic shielding system of claim 11, wherein said securing portion has a second end having an annular ridge formed thereon and extending about said securing portion;

an annular groove extending into and about said securing portion of said coupling assembly.

13. The electromagnetic shielding system of claim 12, additionally including a housing being mounted to said shield assembly for receiving said second end of said securing portion of said coupling assembly, said housing having a first end, an open second end and a peripheral wall extending between said first end and said open second end of said housing.

14. The electromagnetic shielding system of claim 13, wherein said peripheral wall of said housing has a channel extending from said open second end of said housing toward said first end of said housing, wherein said annular ridge of said securing portion is removably secured in said housing through said open second end of said housing, wherein said peripheral wall of said housing is positioned in said annular groove of said securing portion.

15. The electromagnetic shielding system of claim 1, additionally comprising a electromagnetic reflective member being mounted to said shield assembly for shielding a user from electromagnetic waves.

16. The electromagnetic shielding system of claim 1, wherein said electromagnetic reflective member comprises radio frequency reflective tape.

17. An electromagnetic shielding system for shielding a user's head from electromagnetic waves produced from a cellular phone, the cellular phone having an antenna, a front and a rear, the front having a plurality of buttons and a display, said system comprising:

an expandable shield assembly including a base panel and an arm panel being pivotally coupled together, said base panel being removably mountable to the antenna of the cellular phone; and said base panel having a first end, a second end, opposed front and rear planar surfaces and a peripheral edge surface;

said arm panel having a first end, a second end, opposed front and rear substantially planar surfaces, and a peripheral edge surface, wherein said peripheral edge surfaces of said base panel and said arm panel being pivotally coupled together;

wherein said base panel and said arm panel are positionable between a closed position and an open position, wherein said closed position is characterized by said front planar surfaces of said base and arm panels being selectively abutted against each other, wherein said open position is characterized by said front and rear planar surfaces of said base and arm panels lying in a plane;

said peripheral edge surface of said arm panel having an elongated channel extending into said arm panel;

a deflector panel being slidably mounted in said elongated channel for providing expanded protection to a user's head, said deflector panel being positionable between said front and rear planar surfaces of said arm panel;

said deflector panel having opposed front and rear planar surfaces and a peripheral edge surface;

an electromagnetic reflecting member being mounted to and covering said front planar surfaces of each of said panels of said shield assembly for reflecting electromagnetic waves emitted by the antenna of the cellular phone;

wherein said electromagnetic reflecting member comprises a radio frequency reflective tape;

a handle being mounted to said peripheral edge surface of said deflector panel for facilitating gripping of said deflector panel to slide said deflector panel between a retracted position and an extended position, wherein said retracted position is characterized by said deflector panel being positioned between said front and rear panel surfaces of said arm panel, wherein said extended position is characterized by a user pulling said handle such that said deflector panel extends out of said elongated channel;

wherein said shield assembly comprises a substantially rigid material;

a coupling assembly mounted on the shield assembly for removably mounting on the antenna of the cellular phone, said coupling assembly being adapted to position said expandable shield assembly in a stored position and a shielding position, wherein said stored position is characterized by said expandable shield assembly being positionable generally adjacent to the rear of the cellular phone, wherein said shielding position is characterized by said shield assembly being positionable between a user's head and the antenna of the cellular phone;

said coupling assembly including:

a clamp having an annular portion with a pair of tabs defining an opening, wherein said annular portion is removably mountable about the antenna of the cellular phone;

a securing portion for extending between and being coupled to said annular portion and said shield assembly;

said securing portion having a first end rotatably mounted to said annular portion of said coupling member for moving said shield assembly between said stored position and said shielding position and a second end releasably coupled to said rear planar surface of said shield assembly;

said second end of said securing portion having an annular ridge formed thereon extending about said securing portion such that an annular groove extends about said securing portion adjacent to said annular ridge;

wherein said securing portion has a bend therein for positioning said shield assembly adjacent to the front face of the cellular phone and parallel to the rear of the cellular phone when moving said shield assembly between said shielding position and said stored position;

a fastening means being mounted to and extending through each of said tabs of said annular portion of said coupling assembly for securing said tabs together and fastening said annular portion to the antenna of the cellular phone;

a housing being mounted to said rear planar surface of said base panel for receiving said second end of said securing portion of said coupling assembly, said housing having a first end, an open second end and a peripheral wall extending between said first end and said open second end of said housing; and said peripheral wall of said housing having a channel extending from said open second end of said housing toward said first end of said housing, wherein said annular ridge of said securing portion of said coupling assembly is removably secured in said housing through said open second end of said housing, wherein said peripheral wall of said housing is positioned in said annular groove of said securing portion.

* * * * *